US006767006B1

(12) United States Patent
Tripepi

(10) Patent No.: US 6,767,006 B1
(45) Date of Patent: Jul. 27, 2004

(54) DEVICE FOR INTRODUCING A GASEOUS SUBSTANCE IN A FLUID AND USE THEREOF

(75) Inventor: Marco Tripepi, Rome (IT)

(73) Assignee: Centro Sviluppo Materiali S.p.A., Rome (IT)

( * ) Notice: Subject to any disclaimer, the term of this patent is extended or adjusted under 35 U.S.C. 154(b) by 0 days.

(21) Appl. No.: 10/009,303

(22) PCT Filed: Sep. 24, 1999

(86) PCT No.: PCT/IT99/00303

§ 371 (c)(1),
(2), (4) Date: Jun. 6, 2002

(87) PCT Pub. No.: WO00/74832

PCT Pub. Date: Dec. 14, 2000

(30) Foreign Application Priority Data

Jun. 7, 1999 (IT) ..... RM99A0365

(51) Int. Cl.[7] ..... B01F 3/04
(52) U.S. Cl. ..... 261/23.1; 261/64.1; 261/76
(58) Field of Search ..... 261/23.1, 64.1, 261/76, DIG. 75

(56) References Cited

U.S. PATENT DOCUMENTS

RE21,416 E * 4/1940 Sargent
2,241,337 A * 5/1941 Work
2,301,315 A * 11/1942 Opp
2,328,414 A * 8/1943 Beyer
2,980,033 A * 4/1961 Strange et al. ..... 417/196
3,271,304 A * 9/1966 Valdespino et al.
3,563,674 A * 2/1971 Moffat et al. ..... 417/196
3,587,976 A * 6/1971 Jacuzzi
3,799,195 A * 3/1974 Hermans ..... 137/553
4,347,128 A * 8/1982 Barnscheidt
4,429,674 A * 2/1984 Lubbing ..... 261/76
4,552,286 A * 11/1985 Kuckens et al. ..... 222/1
4,634,560 A * 1/1987 Eckert ..... 261/76
4,640,782 A * 2/1987 Burleson ..... 261/DIG. 75
4,722,363 A * 2/1988 Allyn ..... 137/601.18
4,743,405 A * 5/1988 Durao et al. ..... 261/76
5,073,309 A * 12/1991 Bousquet et al. ..... 261/29
5,094,269 A * 3/1992 Agulia ..... 137/564.5
5,298,198 A * 3/1994 LaCrosse ..... 261/76
5,301,718 A * 4/1994 Bolhofner ..... 137/893
5,344,074 A * 9/1994 Spriggs et al. ..... 239/10
5,674,312 A * 10/1997 Mazzei ..... 95/261
5,842,600 A * 12/1998 Singleterry et al. .. 261/DIG. 75

* cited by examiner

*Primary Examiner*—Scott Bushey
(74) *Attorney, Agent, or Firm*—Browdy and Neimark, P.L.L.C.

(57) ABSTRACT

Solubilizing device of a gas into a fluid includes the following components in combination:

at least a first pipe section (1) convergent at the end thereof;

a second pipe section (2), with a cross section smaller than that of the first pipe section (1), coaxial and integral thereto;

a third pipe section (3) divergent for the entire length thereof, coaxial to the second pipe section (2), of a cross section intermediate between the ones of the first and of the second pipe section, the second and the third pipe section being separated by a mixing chamber, provided with a gas introducer (5) and (6), substantially slanted of a ≦90° angle with respect to the axis of the pipe section (2), for the inlet and the adjustment of the gaseous substance to be admixed to the fluid, respectively. The invention also relates to the use of the aforesaid device in various technological fields. The figure shows an embodiment of the device according to the invention.

8 Claims, 1 Drawing Sheet

DEVICE FOR INTRODUCING A GASEOUS SUBSTANCE IN A FLUID AND USE THEREOF

REFERENCE TO RELATED APPLICATIONS

The present application is the national stage under 35 U.S.C. 371 of international application PCT/IT99/00303, filed Sep. 24, 1999 which designated the United States, and which international application was published under PCT Article 21(2) in the English language.

DESCRIPTION

The present invention relates to a device for solubilizing a gaseous substance in a fluid effluent, with high absorption efficiency, and the use thereof.

As it is known, in JP 08 215 614 a unit for atomizing a liquid fuel is disclosed. The unit consists of a first nozzle located in the inlet section and of a suction orifice connected therebelow. The fuel jet exits the first nozzle creating a vacuum in the inlet portion where a gas is inlet through the suction orifice. Then the gas is admixed to the fuel vapor inside a diffusion chamber and is outlet through a second nozzle.

Despite the unquestionable merits of this apparatus and of devices similar to our device, such as that disclosed in U.S. Pat. No. 5,674,312, the need of a device of simpler design, improved adjustment system and higher admixture efficiency still subsists in the specific field and in the neighbouring sectors.

The adoption of the device according to the present invention allows to meet this need, moreover providing other advantages that will hereinafter be apparent.

Therefore, the present invention relates to a device for solubilizing a gaseous substance into a fluid comprising the following components in combination:

- at least a first pipe section convergent at the end thereof;
- a second pipe section, with a cross section smaller than that of the first pipe section, coaxial and integral thereto;
- a third pipe section divergent for the entire length thereof, coaxial to the second pipe section, of a cross section intermediate between the ones of the first and of the second pipe section,
  - the second and the third pipe section being separated by a mixing chamber provided with means, substantially slanted of a $\leqq 90°$ angle with respect to the axis of the second pipe section, for the inlet and the adjustment of the gaseous substance to be admixed to the fluid.

In a variant of the invention, the ratio between the outlet cross section of the second pipe section and the inlet cross section of the third pipe section can be comprised in the range 0.5–0.9.

In a preferred embodiment, the means for the inlet and the adjustment of the gaseous substance to be admixed to the fluid are slanted at an acute angle comprised in the range 30–60°.

The means for adjusting the inlet of the gaseous substance to be admixed to the fluid can be selected from the group comprising at least one gauged hole screw and at least a fine adjusting valve. In the embodiments foreseeing a set of set screws and a set of trimmer valves the cross sections can also differ thereamong.

The means for the inlet and for the adjustment of the inlet of the gaseous substance to be admixed to the fluid in the device according to the invention are always apt to release gaseous substance bubbles of a diameter comprised in the range 50–250 $\mu$m into the fluid.

The use of the device according to the invention can be manifold in the field of engineering; in fact, it can be applied in all those processes in which an adjustment of the gas, in the desired quantities and in the most diffused and homogeneous form attainable inside a liquid vector, is required; i.e. all the gas must be solubilised up to the saturation limits. However, such limit can vary if the process takes place at different pressures, according to the well-known laws governing the solubilization and diffusion phenomena.

The prospective fields of application are mainly of industrial type, however the production of a range of products that cover a wide spectrum of operational pressures and flow rates can also be aimed at uses that are not typically industrial.

The main industrial fields of application of the device according to the present invention are:

- waste water treatment for VOCs (Volatile Organic Compounds) abatement;
- ozone-performed water disinfection;
- waste water aeration for the elimination of oils and greases;
- preparation of mixtures to be atomized;
- preparation of mixtures for thermochemical pickling treatments.

Among the uses in non-industrial fields, the device according to the present invention can be used as $O_2$ mixer in water, useful in acquariums of amateur type as well as of a considerable size, as those owned by amusement parks (e.g., the Genoa Acquarium).

Usually, in the above-mentioned uses the device according to the invention works under the following operating conditions:

| | |
|---|---|
| Fluid feed rate | >15 m/s |
| Fluid outlet rate | (0.9–0.2) times the feed rate |
| Length of pipe section 3 | (10–20) times the smaller cross section of the pipe section 3 |
| Bubble diameter of the gaseous substance | 50–250 $\mu$m |

With respect to devices already existing in the prior art or commercially available, the device for solubilizing gaseous substance into fluids according to the invention has the following advantages:

- higher efficiency;
- simpler design, entailing easier operation and maintainance;
- lower production costs;
- wider adjustment range;
- higher suitability to manifold uses.

So far, only a general description of the device subject matter of the present invention has been provided. With reference to the annexed figures, a more detailed description of a specific embodiment of the invention will now be given, aimed at providing a better understanding of the objects, characteristics, advantages and operating mechanism thereof.

Figure 1:
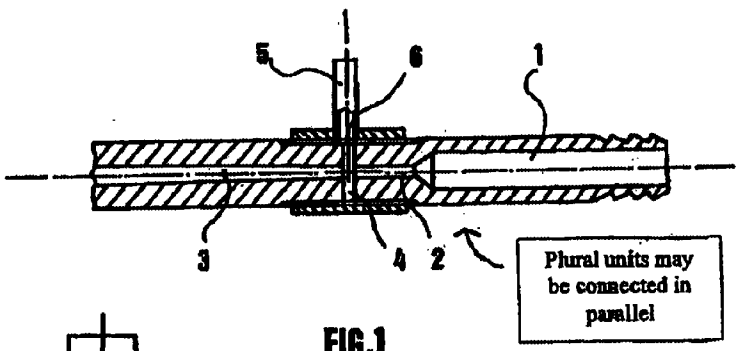
FIG. 1 is a longitudinal section of an embodiment of the device for solubilizing a gaseous substance into a fluid according to the present invention.
Figure 1A:
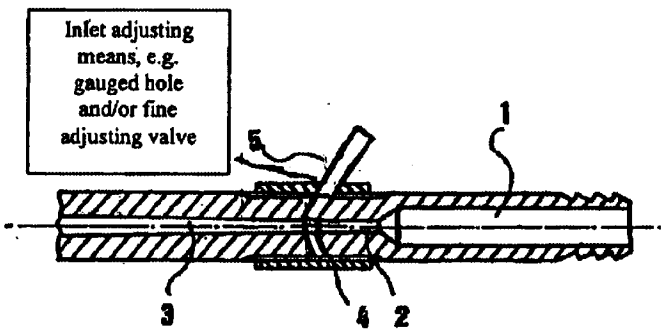
FIG. 1A is a longitudinal section of an embodiment of the device for solubilizing a gaseous substance into a fluid according to the present invention, which details alternatives for the gaseous substance inlet.
Figure 2:
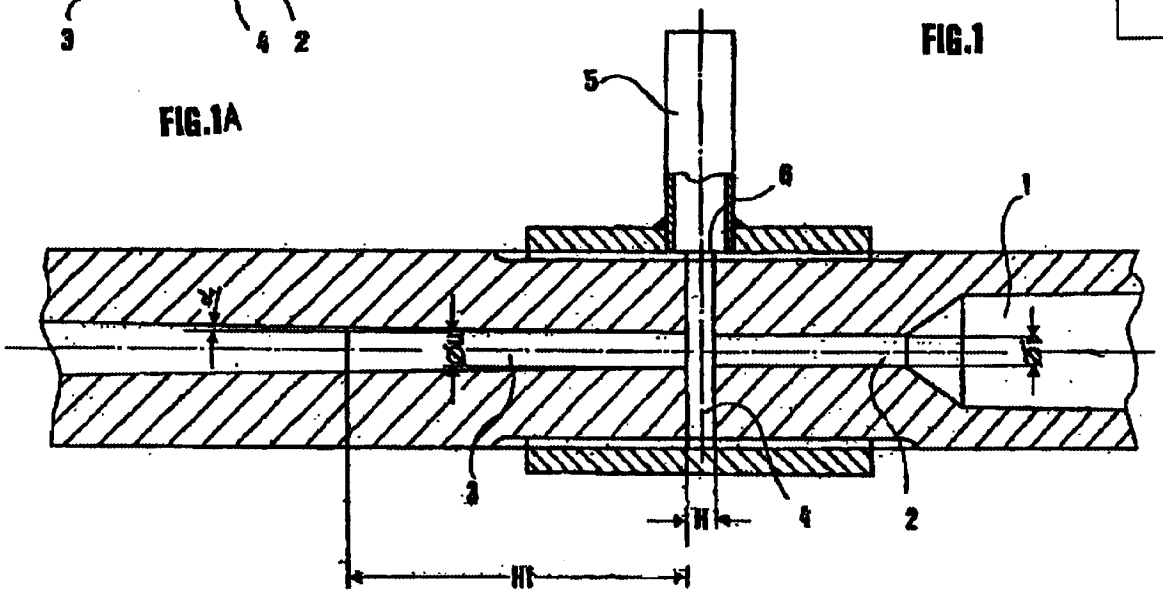
FIG. 2 is an enlargement of the median portion in FIG. 1, better highlighting some details of the design.

With reference to FIGS. 1, 1A and 2, the fluid, the flowing sense thereof being indicated by the horizontal arrows, is fed under pressure firstly into the pipe section 1 (hereinafter referred to also as feed pipe) convergent at the end thereof, and subsequently into the pipe section 2 (hereinafter referred to also as nozzle) wherefrom it outlets into the mixing chamber 4. The gas flows into the mixing chamber 4 of length H through the piping 5 provided with a gauged hole 6, wherein a pressure lower than that existing in the pipe sections 2 and 3 is provided, due to the stream expansion during the passage of the fluid from the nozzle 2 into the pipe section 3 divergent for the entire length H1 thereof of an opening half angle α (pipe section hereinafter referred to also as diffuser) coaxial to the pipe section 2 and with cross sections of an intermediate diameter between that of the feed pipe 1 and of the nozzle 2.

In this mixing area, the liquid forms a frustoconic surface in which the nucleation of the gas bubbles begins. These, once formed, start spreading inside the liquid effluent, reaching ever-smaller sizes (micronized bubbles).

The system can be considered closed as far as the gas and liquid circuits are concerned, therefore the total energy content thereof remains constant.

Leaving out the flow resistance, the total energy of the effluent fluid consists of only two aliquots: the pressure energy and the kinetic energy. The latter decreases at the passage from the nozzle 2 to the diffuser pipe 3, as the velocity changes with a ratio inverse to that of the outflow cross sections (considering, at a first rough calculation, the variation in density due to the presence of the gas bubbles to be negligible, as they are microscopic and readily absorbed into the fluid).

The decrease of kinetic energy converts into static pressure energy, increasing of a quantity equal to the decrement of the kinetic energy. The gas drawn by the lower pressure of the mixing chamber 4, inverts the expanding liquid with an angle comprised between that of the slanting of the frustoconical section of the expanding liquid and 90°.

In this section, the side surface of the liquid is free, therefore more permeable to the gas diffusion. Moreover, such permeability is increased at the surface of liquid-gas interface, as entailed by the fluidodynamic conditions of the fluid stream, providing more favorable conditions for the gas absorption into the liquid. This surface results markedly rippled by the billows of the accelerating fluid, thus generating a sort of superficial roughness. These very small asperities act as nucleation sites of the bubble, resulting to be of a microscopic size, as the size of the asperities and the size of the bubble itself are related.

Hence, the frustoconic surface of the fluid stream is the site from which the gas begins to diffuse into the liquid. A process adjustment can be carried out varying the surface size. This control of the surface overcomes the problem from a fluidodynamic point of view, whereas the adjustment applied to the gas flow through a set of gauged hole screws 6 (one of which is shown in the figures) with suitable cross sections, faces the process control problem from the point of view of the gas diffusion into the fluid, and of its subsequent solubilization. These gauged hole screws 6 limit the gas inflow to quantities ensuring a total solubilization thereof.

In fact, depending on the flow rates of the outflowing liquid, operating conditions, are set in the diffusion area which allow a variation of the solubilization limit to take place. The control is carried out by a logical device that, according to the flow rate of the outflowing liquid, selects, within the range of available gauged holes 6, the one suited to the specific operating conditions taking place in the diffusion area.

The device according to the present invention can be used by itself or connected in parallel to others of equal, higher or lower capacity.

The use in parallel of the devices according to the invention is particularly suitable in processes where gas-metal heterogeneous reactions need to be performed, in which the sole function of the liquid is that of feeding the gas to the interface in the desirable quantities, i.e., not underfeeding, nor overfeeding. This is so as, on one hand, the maximum possible reaction yield is desirable, avoiding on the other hand the occurrence of undesired side reactions in the required process. An instance, wherein the device according to the invention was connected also in parallel with others and yielded excellent results in practice, is that of the thermochemical pickling treatments. These uses constitute mere examples, not exhausting the range of the possible application.

EXAMPLE

One cubic meter of pickling solution has the following composition in g/l:

| | |
|---|---|
| $Fe^{+2}$ | 60 |
| $Fe^{+3}$ | 30 |
| HF | 50 |
| $H_2SO_4$ | 150 |
| Solution temperature | 65° C. |
| Pressure | 5 bar |

and a K value corresponding to 0.5, K being the $F^{+3}/Fe^{+2}$ ratio.

In order to obtain a pickling solution with K=2 (i.e., after oxidation of 30 g/l of $Fe^{+2}$ to $Fe^{+3}$) the ferrous ion $Fe^{+2}$ is oxidized according to the following reaction:

$$4Fe^{+2}+O_2+4H+\rightarrow 4Fe^{+3}+2H_2O$$

The oxygen required for the reaction is provided with a device according to the invention that operates with the following characteristics:

| | |
|---|---|
| Initial velocity of solution | 25 m/s |
| Final velocity of solution | 8 m/s |
| Initial pipe cross section/ final cross section ratio | 0.6 |
| Oxygen flow rate | 480 N1/h |
| Solution flow rate | 5 $m^3$/h |
| Length of mixing chamber (H) | 1 mm |
| Length of pipe section 3 (H1) | 25 mm |
| α | 1° |

The stoichiometric volume of the $O_2$ to be fed is 3 $Nm^3$, however, considering that the device efficiency—i.e., the ratio between reacted $O_2$ quantity of and fed $O_2$ quantity—times one hundred—is 0.85, the effective volume actually to feed in order to obtain the desired oxidation is 3.55 $Nm^3$. The time required to carry out the reaction is 7.4 h. The transfer factor (fed $O_2$ quantity per unit of supplied energy) is 1112 $NlO_2$/Kwh=1.6 $KgO_2$/Kwh.

What is claimed is:

1. A device for solubilizing a gaseous substance into a fluid comprising the following components in combination:

at least one first pipe section (1) having a first circular cross-section and convergent at an end thereof downstream from said first cross-section;

a second pipe section (2), with a circular cross section smaller than said first cross-section of said pipe section (1), coaxial and integral thereto;

a third pipe section (3) divergent for the entire length thereof, coaxial to the second pipe section (2), of a circular cross section intermediate between the first cross-section and the cross-section of the second pipe section, the second and the third pipe section being separated by a mixing chamber (4) provided with means (5) and (6), substantially slanted of a $\leqq 90°$ angle with respect to the axis of the pipe section (2), for the inlet and the adjustment of the gaseous substance to be admixed to the fluid, respectively, and the ratio between the outlet cross section of the second pipe section (2) and the inlet cross section of the third pipe section (3) being in the range 0.5–0.9.

2. The device for solubilizing a gaseous substance into a fluid according to claim 1, wherein the means (5) and (6) for the inlet and the adjustment of the gaseous substance to be admixed to the fluid are slanted at an acute angle in the range 30–60° with respect to the axis of the pipe section (2).

3. The device for solubilizing a gaseous substance into a fluid according to claim 1 or claim 2, wherein the means (6) for the adjustment of the inlet of the gas to be admixed to the fluid are selected from the group consisting of at least one gauged hole and at least one fine adjusting valve.

4. The device for solubilizing of a gaseous substance into a fluid according to claim 1 or claim 2, wherein the means (6) for the adjustment of the inlet of the gas to be admixed to the fluid consist of a plurality of gauged holes or of fine adjusting valves, with cross-sections of the same or different sizes.

5. A system for solubilizing a gaseous substance into a fluid comprising a plurality of devices according to claim 1 or claim 2, connected together in parallel.

6. The system of claim 5 wherein said devices connected in parallel have the same or different capacities.

7. A system for solubilizing a gaseous substance into a fluid comprising a plurality of devices according to claim 3, connected together in parallel.

8. In a method of solubilizing a gaseous substance into a fluid using a device for passing the gaseous substance as a gas or vapor into the fluid, the improvement wherein said device is the device of claim 1 or claim 2.

* * * * *